United States Patent [19]

Carse

[11] 4,157,772

[45] Jun. 12, 1979

[54] VOLUME ADJUSTABLE AND EASILY DISASSEMBLED FLUID DISPENSING APPARATUS

[76] Inventor: Clifford C. Carse, 500 Woodcrest Ct., Boulder City, Nev. 89005

[21] Appl. No.: 786,452

[22] Filed: Apr. 11, 1977

[51] Int. Cl.[2] ..... B67D 5/06

[52] U.S. Cl. ..... 222/180; 222/309; 222/341; 417/402

[58] Field of Search ..... 222/180, 286, 309, 333, 222/341, 373, 379, 380, 400.5, 407, 409, 504; 417/264, 402, 514, 554

[56] References Cited

U.S. PATENT DOCUMENTS

| | | | |
|---|---|---|---|
| 3,149,753 | 9/1964 | Forsyth | 222/309 X |
| 3,160,331 | 12/1964 | Trumbull et al. | 222/309 |
| 3,269,601 | 8/1966 | Weber | 222/180 X |
| 3,372,843 | 3/1968 | Soodalter | 222/309 |
| 3,393,833 | 7/1968 | King | 222/180 X |
| 3,601,845 | 8/1971 | Mavrich | 222/373 X |
| 3,664,550 | 5/1972 | Carothers et al. | 222/144.5 X |
| 4,053,089 | 10/1977 | Gamadia | 222/341 X |

*Primary Examiner*—Robert J. Spar
*Assistant Examiner*—Fred A. Silverberg
*Attorney, Agent, or Firm*—Romney, Schaap, Golant, Scillieri, Disner & Ashen

[57] ABSTRACT

A liquor dispensing apparatus for automatically moving liquor from its bottle to a hand held nozzle to facilitate the preparation of drink, the dispensing apparatus including a pump which is simply constructed, relatively inexpensive and highly reliable. The pump includes a glass cylinder to allow inspection and preventive maintenance, two one way valves, solenoid actuation of the piston and an adjustment element for precisely controlling the amount of liquor pumped with each stroke of piston. The pump is held together by a bracket which allows quick disassembly and assembly of the pump without the need for tools.

6 Claims, 7 Drawing Figures

VOLUME ADJUSTABLE AND EASILY DISASSEMBLED FLUID DISPENSING APPARATUS

BACKGROUND OF THE INVENTION

1. Field of the Invention

The present invention relates to a fluid dispensing apparatus including a pump and more particularly to a fluid dispensing apparatus for adjustably metering a liquid between a liquid source such as a bottle and a dispensing nozzle. 2. Description of the Prior Art The apparatus disclosed herein relates primarily to the dispensing of a metered amount of liquor in an automatic manner. Other of my inventions relating to the movement of liquor between a bottle and a consumer's glass may be viewed by reference to U.S. Pat. Nos. 3,664,552 and 3,628,566 and co-pending application, Ser. No. 732,020, now U.S. Pat. No. 4,076,148.

In view of the value of alchoholic beverages efforts have been made to control the amount of liquor which is dispensed for each drink prepared. In the past this was done by simply using uniformly sized glasses into which the liquor was poured. Liquor has also been metered by attaching a simple spout which pours a more or less constant amount each time the liquor bottle is inverted. Of course a readily apparent problem with either of the above techniques is that the liquor bottle must be handled each time a drink is prepared and the metering has not been very precise. In addition, an automatic count of each drink prepared was unattainable.

More recently, commercial establishments have sought devices which will improve the efficiency of the people employed to prepare drinks. One technique was to keep the bottle of liquor at a remote location and have the liquor pump through conduits to a more convenient hand held nozzle such as shown in the above mentioned patents and application.

While the remote placement of liquor bottles has proven to be more efficient than handling the bottle for each drink prepared, problems have developed relating to the design of suitable pump units. Prior art pumps have been unreliable, overly complicated in structure, difficult to clean and unsuited for convenient preventive maintenance. In an industry requiring efficiency and sanitary conditions these problems have been difficult to solve.

SUMMARY OF THE INVENTION

The present invention solves the above mentioned problems in the prior art by providing a fluid dispensing apparatus comprising a support structure; a source of fluid mounted to the support structure; a dispensing nozzle connected to the support structure; and a pump mounted to the support structure for communicating the source of fluid and the dispensing nozzle, the pump including a cylinder; a piston having first and second sides linearly movable within said cylinder between first and second positions as a function of the selective application of pressure to the first side and a biasing force to the second side; means positioned within the cylinder and bearing upon the second side of the piston for biasing the piston to its first position; a first one way valve including a spring, a valve element and a valve seat connected to one portion of the cylinder for passing fluid into the cylinder when the piston is moved by the biasing means from the second position to the first position and for blocking the passage of fluid when the piston is moved from its first position to its second position; a second one way valve including a spring, a valve element and a valve seat located within and movable with the piston for passing fluid out of the cylinder when the piston is moved by the application of pressure from its first position to its second position and for blocking the passage of fluid when the piston is moved from its second position to its first position; a first fluid conduit connected to the one portion of the cylinder for passing fluid to the first one way valve and the cylinder; a second fluid conduit connected to another portion of the cylinder for passing fluid out of the cylinder through the second one way valve; a pressure source for communicating a high pressure to the first side of the piston to move the piston from its first position to its second position whereby the cylinder is filled with fluid when the piston moves from its second position to its first position and the cylinder is emptied of fluid when the piston is moved from its first position to its second position.

An aim of the present invention is to provide a fluid dispensing apparatus which is simply constructed, relatively inexpensive and highly reliable.

Another aspect of the present invention is to provide a fluid dispensing apparatus which is extremely easy to disassemble without the use of tools for cleaning and servicing and then to reassemble, again without the use of tools.

Still another object of the present invention is to provide a fluid dispensing apparatus which allows facilitated inspection and preventive maintenance.

Other objects and advantages of the invention will appear from the description taken in conjunction with the accompanying drawings.

DESCRIPTION OF THE PREFERRED EMBODIMENT

Figure 3:
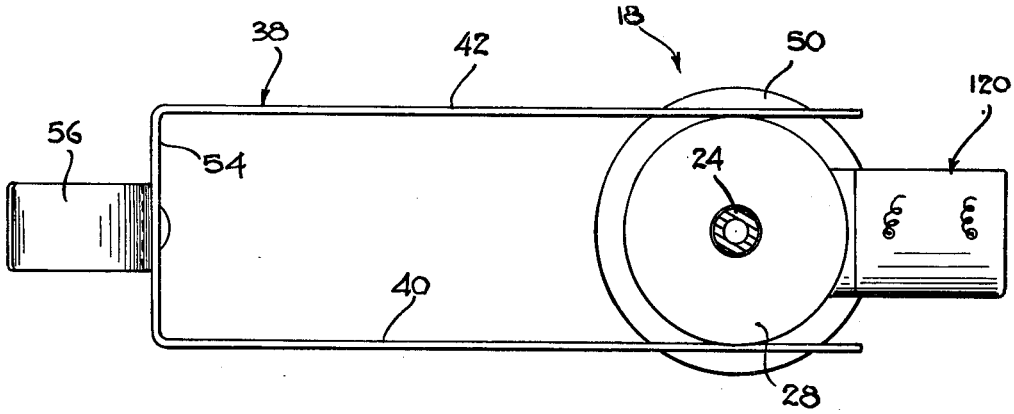
FIG. 3 is a plan view of the pump shown in FIG. 2 taken along the line 3—3 of FIG. 2.

While the present invention is susceptible of various modifications and alternative constructions, an illustrative embodiment is shown in the drawings and will herein be described in detail. In should be understood, however, that it is not the intention to limit the invention to the particular form disclosed; but on the contrary, the invention is to cover all modifications, equivalences and alternative constructions falling within the spirit and scope of the invention as expressed in the appended claims.

Figure 1:
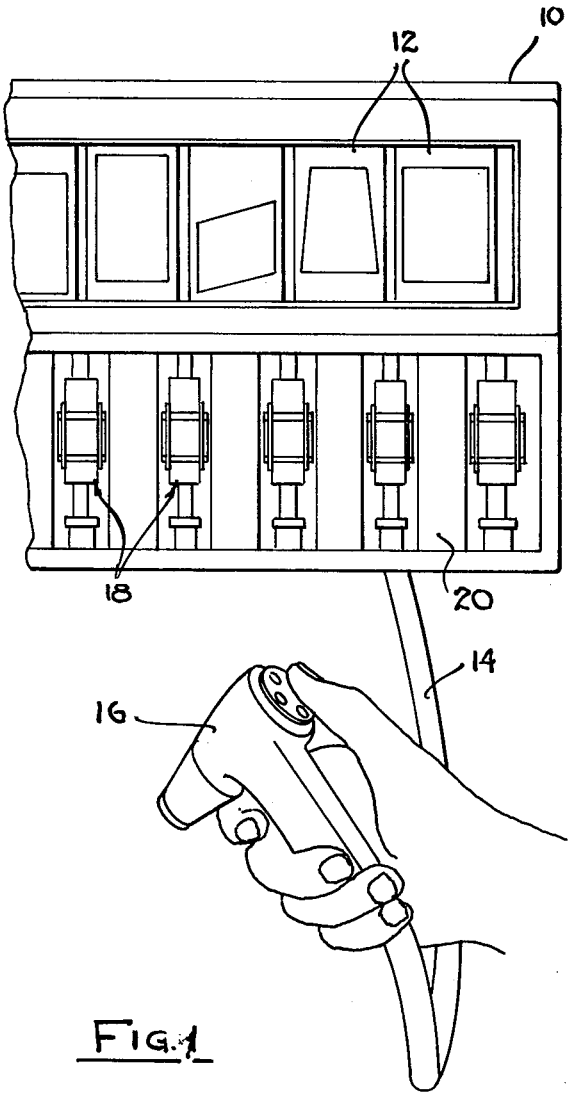
FIG. 1 is a perspective view of a fluid dispensing apparatus.

Referring now to FIG. 1 the field dispensing apparatus comprises a support structure 10 in the form of an aesthetically appealing frame capable of carrying a number of fluid sources 12 in the form of liquor bottles. Connected to the support structure by a flexible hose 14 is a hand held dispensing nozzle 16. Mounted within the support structure at a level below the liquor bottles 12 are a plurality of fluid dispensing pump systems 18, one pump system for each bottle.

From a review of FIG. 1 it is apparent that the apparatus is relatively simply constructed and that the use of glass and clear plastic allows for facilitated inspection while at the same time adding to its pleasing aesthetic appearance.

Figure 2:
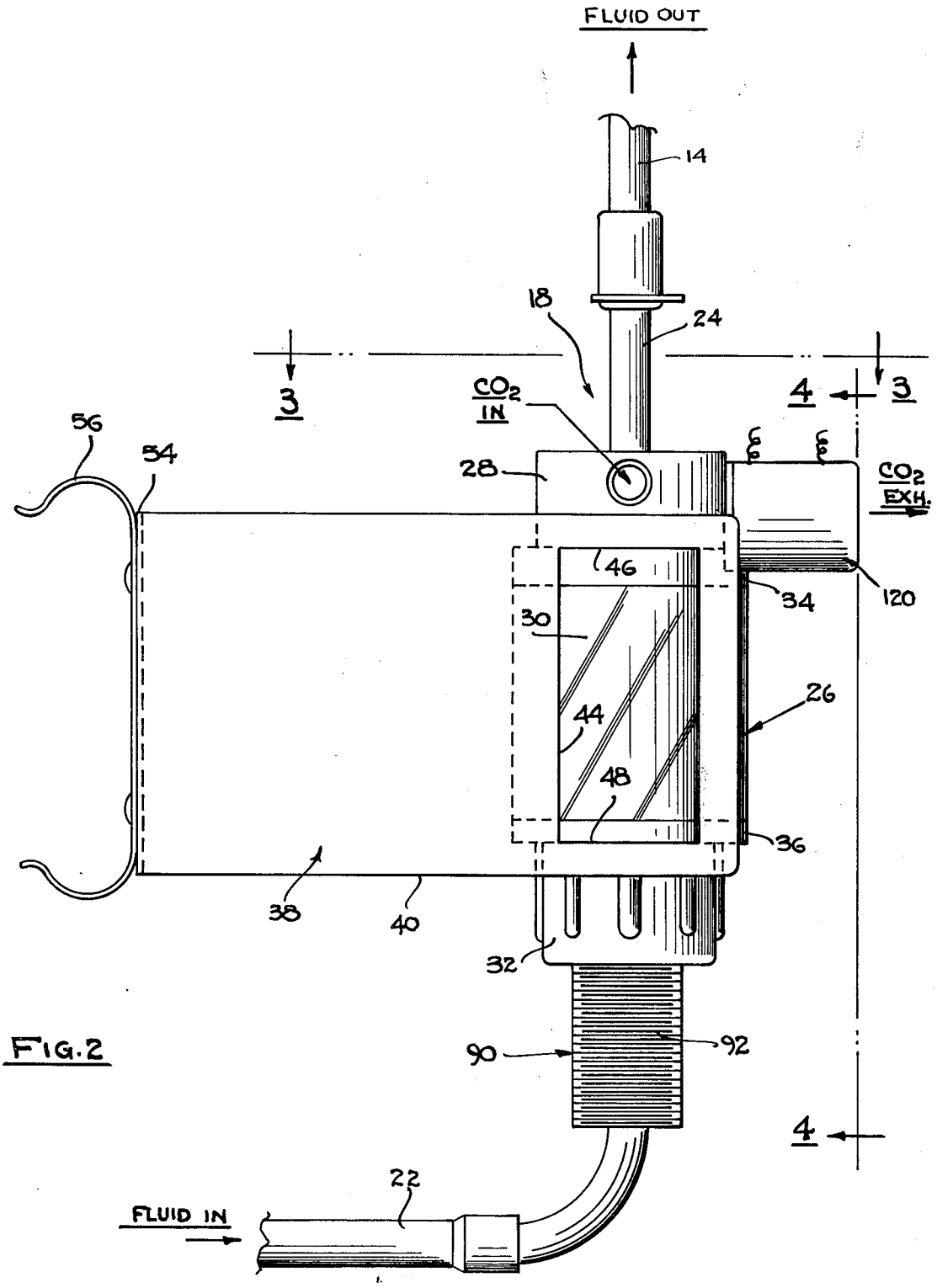
FIG. 2 is an enlarged side elevational view of the fluid dispensing pump.

To trace the liquor flow from the bottles 12 to the dispensing nozzle 16 reference is made to FIGS. 1 and 2. The liquor fills a reservoir tube 20 and a first fluid conduit 22. The fluid is then passed through the dispensing pump system 18 to a second fluid conduit 24 which is connected to the flexible hose 14 and the hand held dispensing nozzle 16.

Figure 4:
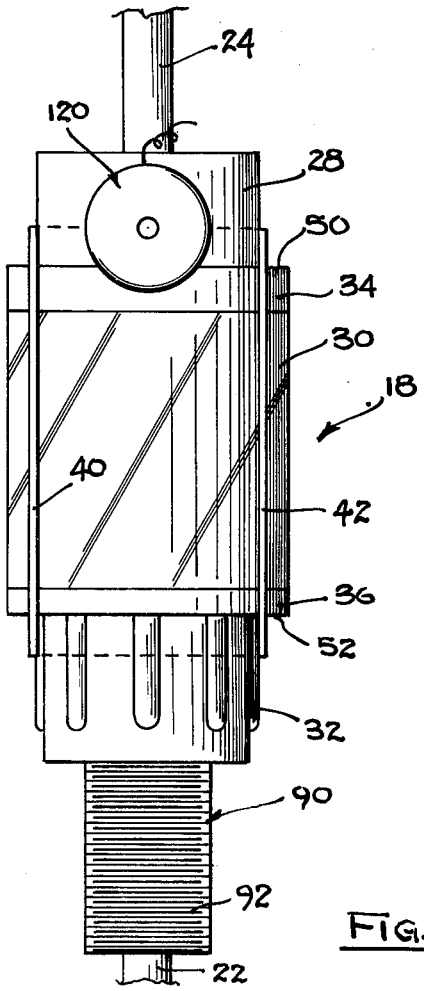
FIG. 4 is a front elevational view of the pump of FIG. 2 taken along the line 4—4 of FIG. 2.

To appreciate the ease by which the dispensing pump system 18 can be disassembled for inspection, cleaning or the like reference is made to FIGS. 2, 3 and 4. The pump system includes a cylinder 26 having a first upper portion 28, a central portion 30 and a second lower portion 32. As can be readily seen the central portion 30 has the largest diameter of the cylinder; this diameter is also shared by a flange 34 of the upper portion 28 and a flange 36 of the lower portion 32. As will be explained herein below there is a compression spring (spring 110) within the cylinder biasing the upper, central and lower portions of the cylinder away from each other. Preventing this separation is a bracket 38 having a generally U-shape (FIG. 3) with two extending arms 40 and 42 and a base 54. At the extended portion of the arms are rectangular openings such as opening 44 in the arm 40. The rectangular openings have opposite ends, such as ends 46 and 48 which engage portions of annular surfaces 50 and 52 of flanges 34 and 36 respectively. At the base 54 of the bracket is attached a flexible clip 56 for mounting the bracket and the pump system to the support structure 10.

While the material for the bracket may be of any suitable type, a flexible sheet of the aluminum having a thickness of approximately 0.0625 inches has been found to work well. The bracket is constructed so that its equilibrium or "at rest" position finds the arms 40 and 42 slightly converging in a direction moving away from the base 54. Nevertheless, the bracket is sufficiently pliable to allow the arms to be manually flexed to a position in which the arms are diverging in a direction moving away from the base 54. In this simple manner the pump assembly may be removed or installed without the need for tools. The bracket is simply manipulated by an operators hands. In order to assure a secure fit the arms 40 and 42 extend in a generally parallel manner when attached to the pump system as shown in FIG. 3. Since the bracket arms have a tendency to return to their equilibrium position, slightly converging, there is a biasing force acting on the pump system from the bracket arms keeping the bracket arms tightly about the pump system. This keeps the pump system securely in place.

Emphasizing a major advantage of the structure just described it is now apparent that the removal of the pump system from the support structure can be accomplished very quickly by simply manually manipulating the bracket arms 40 and 42. There is no need for any special tools nor is there a need to consume time disconnecting the usual fasteners.

Figure 5:
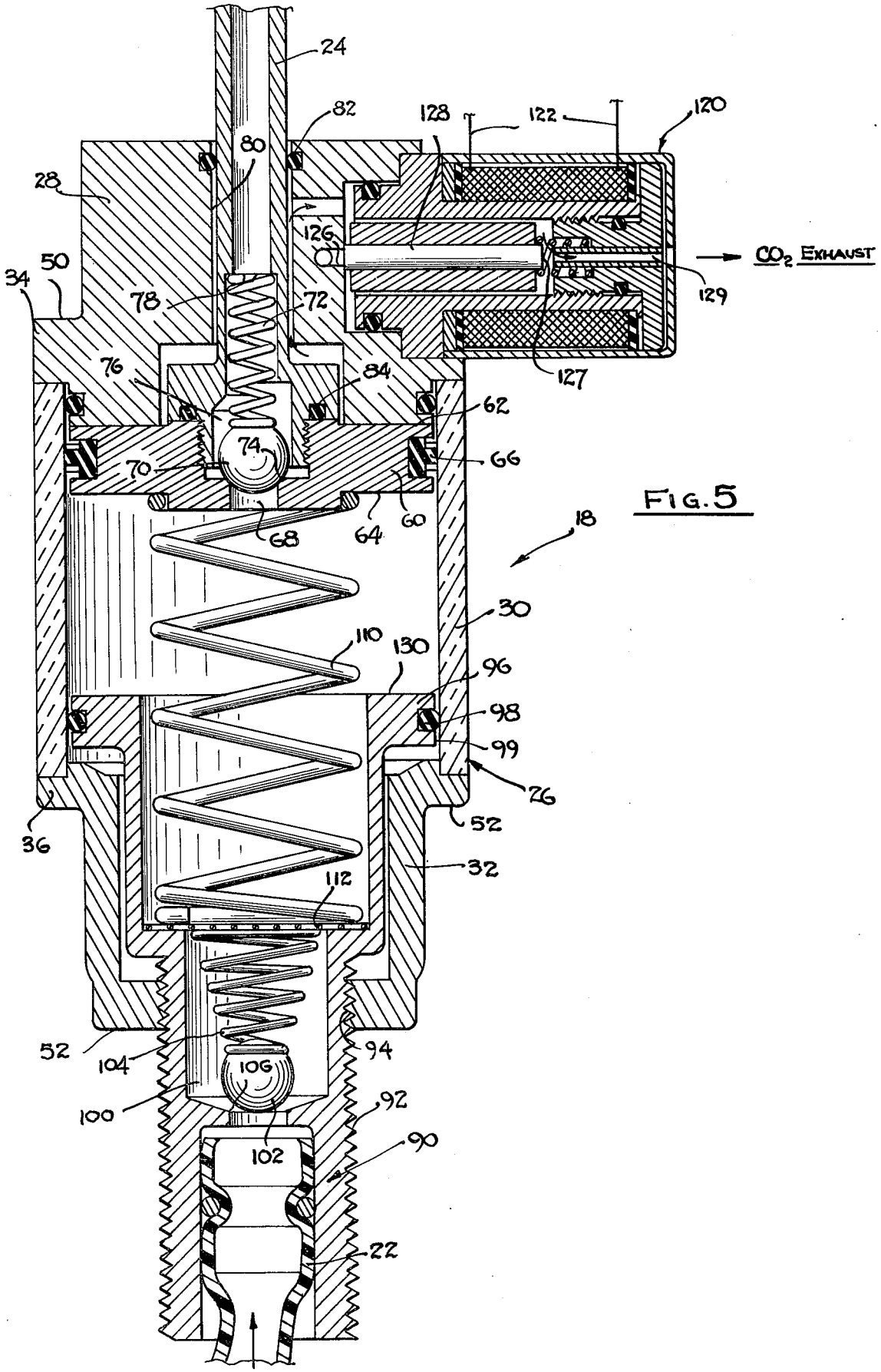
FIG. 5 is a enlarged sectional elevational view of the pump illustrating the piston in its first position.
Figure 6:
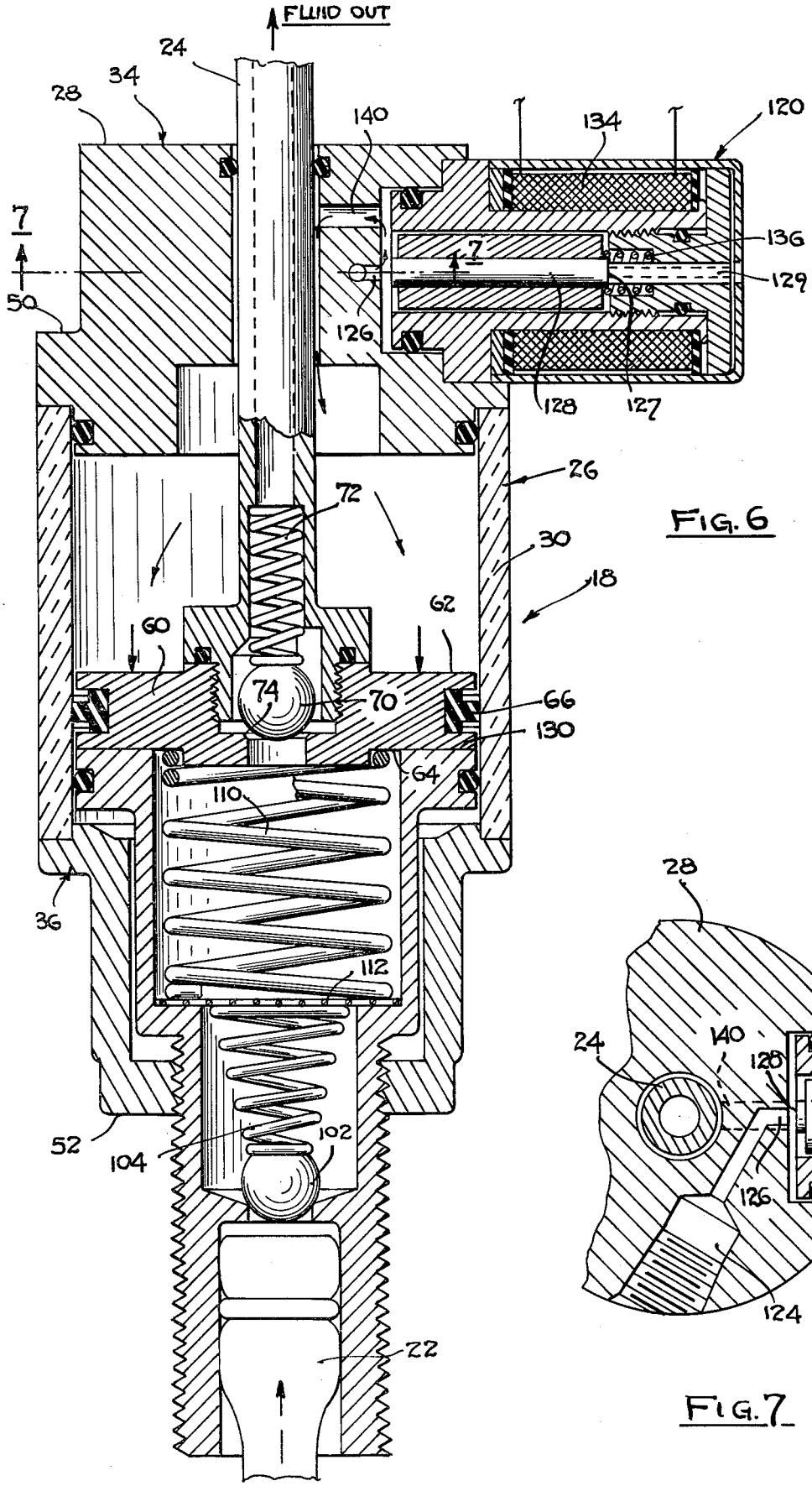
FIG. 6 is a sectional elevational view of the pump showing the piston in its second position.
Figure 7:
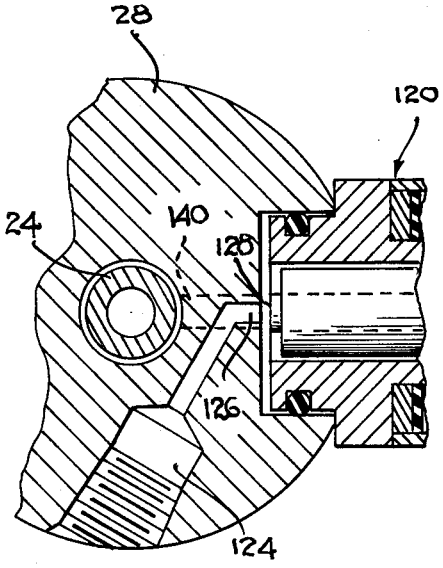
FIG. 7 is a sectional view taken along line 7—7 of FIG. 6.

Referring now to FIGS. 5, 6 and 7 the interior of the pump system is disclosed in more detail. As already mentioned the cylinder 26 includes three sections, an upper portion 28, a central portion 30 and a lower portion 32. While the upper and lower portions may be made of any suitable material such as a synthetic resin, the central portion 30 is a glass tube. The glass allows the interior of the cylinder to be visually inspected at any time and the application of preventive maintenance. For example, impurities which might have been within the liquor bottles and then pumped into the cylinder may be detected and removed.

Linearly movable within the cylinder is a piston 60 having a first side 62 and an opposite second side 64. About the periphery of the piston is a seal 66. Located in the middle of the piston is an opening 68 which communicates with the interior of the second fluid conduit 24. Located within the opening 68 and a chamber 76 within the conduit 24 is a one way check valve including a movable valve element in the form of a ball 70, a compression spring 72 and a valve seat 74. The ball 70 is movable within the chamber 76 from the closed position shown in FIG. 5 to the open position shown in FIG. 6. The spring 72 is positioned between the ball and a shoulder 78 formed in the conduit 24. The conduit is threadedly engaged to the piston and is movable through a central opening 80 in the cylinder upper portion 28. Between the cylinder upper portion and the second fluid conduit is a O-ring seal 82; between the conduit and the piston is another O-ring seal 84. Mounted to the other end of the cylinder is the first fluid conduit 22 and a movable volume adjustment element 90. The adjustment element has a first or lower part having an outside thread 92 engagable with a threaded opening 94 of the cylinder lower portion 32. The adjustment element also includes a second or upper part 96 which is in the form of a cup. Between the outer periphery 99 of the cup and the interior of the cylinder central portion 30 is an O-ring seal 98.

Within the lower threaded part 94 of the adjustment element there is a chamber 100 within which is another one way check valve including a movable ball 102, a compression spring 104 and a valve seat 106. As with the first check valve the second check valve is movable in only one direction from the open position shown in FIG. 5, to the closed position shown in FIG. 6. Within the cylinder and partially within the cup of the adjustment element is a large compression spring 110. This spring is mounted between the second face 64 of the piston and the base of the cup of the adjustment element. Adjacent the lower end of the spring 110 is a screen 112. It is apparent that all of the liquid entering the cylinder passes through the screen 112.

Mounted to the cylinder upper portion 28 is a solenoid 120 which is suitably connected to an electrical power source (not shown) by wires 122 shown in diagramatic form. Formed within the cylinder upper portion 28 is a passage 124, FIG. 7, which is in communication with a source of high pressure such as a canister of $CO_2$ gas (not shown). The passage 124 terminates at an opening 126 immediately adjacent the end of the solenoid plunger 128. Opposite the other end 127 of the solenoid is a exhaust passage way 129.

It is now apparent that the volume of liquor pumped through the system lies between the piston and the upper end 130 of the adjustment element. It is to be understood, however, that the adjustment element is able to rotate relative to the cylinder and thereby move linearly within the cylinder to enlarge or contract this volume of liquor to be pumped. This advantageous feature allows for the precise control of the amount of liquor which is dispensed with each stroke of the piston. In one embodiment the cylinder and the adjustment element are dimensioned to allow the pumping of between one-half and two ounces of liquor with each stroke of the piston.

In operation, the pump assembly is at rest similar to that shown in FIG. 5. The piston is in its first position at one end of its stroke, the solenoid, plunger 128 is biased against the opening 126 by a coiled spring 136 to block the entrance of high pressure $CO_2$ gas, the ball 102 of the first valve is tightly seated so as to block the flow of liquor and the ball 70 of the second valve is seated to also block the flow of liquor. When an operator activates the hand held dispensing nozzle an electrical signal is set to the solenoid to activate the electrical coil 134 which retracts the plunger 128 against the spring 136. This blocks the exhaust passage 129 but opens the passage 124 to allow $CO_2$ gas to pass through passage 140, FIG. 6, around and along the conduit 24 and then downwardly to act upon the first surface 62 of the piston as shown by the arrows in FIG. 6.

As the piston moves downwardly as depicted in FIG. 6, the incompressible liquor will force the first check valve open to allow the liquor to escape through the conduit 24. At the same time the spring 110 is compressed by the downward movement of the piston. The piston will continue downwardly until it reaches the end of its stroke or second position in which the face 64 abuts the face 130 of the adjustment element. During the decent of the piston, the solenoid plunger will return under the influence of its spring to block the opening 126. Without the high pressure gas acting on the piston, the large compression spring 110 will push against the piston to return it to the beginning of its stroke or its first position. During this return stroke, the $CO_2$ gas is pushed back to the solenoid plunger, around the plunger and out the exhaust passage 129. Also the first valve will have closed under the influence of the spring 72. However, upon the return of the piston, the pressure within the cylinder is reduced below that of atmospheric pressure which in turn causes a pressure differential to be created about the ball 102 of the second valve. This pressure differential will open the valve to allow the passage of liquor from the first fluid conduit 22 into the cylinder and thereby preparing the pump system for its next cycle.

It can be appreciated that the operation just described occurs very quickly so that liquor can be easily and quickly dispensed. It is now also apparent that the structure of the pump system is relatively simple and easily maintainable. For example, in comparison to a flexible diaphragm, the piston 60 will last indefinitely. Only the sealing element 66 will have to be replaced. In addition, because of the transparent cylinder center portion 30, any contaminants which may have passed the screen 112 can be easily seen to allow cleaning before an unwanted blockage occurs. This allows "down time" to be kept to a minimum because foreign material may be removed prior to a failure of the pump system. In the prior art there was no way to tell that the pump was in trouble until failure actually occurred. Furthermore, a counter may be connected to the electrical power source and the solenoid so that each stroke of the piston is recorded.

In addition to the above advantages, the disclosed pump system can be easily disassembled for cleaning purposes and quickly reassembled for use. It is to be understood that in view of the material being handled, i.e. alcoholic beverages, there is a health requirement that the equipment be cleaned frequently. Furthermore, because of the chemical composition of alcoholic beverages, frequent cleaning is required in order for the pump to avoid clogging. Therefore, a simple, reliable and commercially viable system is presented with numerous advantages for efficient and effective use.

What is claimed is:

1. A fluid dispensing apparatus comprising:

a support structure for holding a fluid source;

means connecting said structure to a dispensing nozzle;

a pump mounted to said support structure for communicating said source of fluid to said dispensing nozzle, said pump including:

(a) a cylinder having freely but abuttingly related upper, lower and central portions;

(b) a piston having first and second sides linearally movable within said cylinder between first and second positions as a function of the selective application of pressure to said first side and a biasing force to said second side;

(c) spring means positioned within said cylinder and bearing upon said second side of said piston for biasing said piston to its first position;

(d) an adjustment element threadedly mounted to said lower portion of said cylinder for varying the pumping volume of said cylinder;

(e) a second one-way valve including a spring, a valve element and a valve seat mounted within said adjustment element for passing fluid into said cylinder when said piston is moved by said biasing means from said second position to said first position and for blocking the passage of fluid when said piston is moved from said first position to said second position;

(f) a first one-way valve including a spring, a valve element and a valve seat located within and movable with said piston for passing fluid out of said cylinder when said piston is moved by the application of pressure from said first position to said second position and for blocking the passage of fluid when said piston is moved from said second position to said first position;

(g) a first fluid conduit communicating with said second one-way valve for passing fluid into said cylinder;

(h) a second fluid conduit connected to said piston for passing fluid out of said cylinder after said fluid passes through said first one-way valve;

(i) passage means for communicating a high pressure source to said first side of said piston to move said piston from its first position to its second position whereby said cylinder is filled with fluid when said piston moves from its second position to its first position and said cylinder is emptied of fluid when said piston is moved from its first position to its second position; and (j) control means operable with said passage means for selectively opening and closing said passage means.

2. A fluid dispensing apparatus as claimed in claim 1 where, said adjustment element includes a lower externally threaded portion in which is located said second one-way valve, and an upper cup-shaped portion having an upper surface for locating the second position of said piston.

3. A fluid dispensing apparatus as claimed in claim 1 including, a dispensing nozzle connected to said support structure; and wherein said central portion of said cylinder is of glass material.

4. A fluid dispensing apparatus as claimed in claim 1 including, a bracket having two arms each with an opening, said bracket for receiving said cylinder in said arm openings wherein said upper and lower portions are retained by said bracket with said central portion.

5. A fluid dispensing apparatus as claimed in claim 4 wherein, said bracket bears against said upper and lower portions.

6. A fluid dispensing apparatus as claimed in claim 1 including, a dispensing nozzle connected to said support structure;

a bracket having two arms each with an opening, said bracket for receiving said cylinder in said arm openings wherein said upper and lower portions are retained by said bracket with said central portion; and wherein said central portion of said cylinder is of glass material; and said adjustment element includes a lower externally threaded portion in which is located said second one-way valve, and an upper cup-shaped portion having an upper surface for locating the second position of said piston.

* * * * *